US006931904B2

(12) United States Patent
Jones et al.

(10) Patent No.: US 6,931,904 B2
(45) Date of Patent: Aug. 23, 2005

(54) METHOD OF FORMING A TRAILER RECEIVER TUBE USING HOLLOW FORWARD EXTRUSION

(75) Inventors: Darrin F. Jones, Alliance, OH (US); John A. Pale, Troy, MI (US); David J. Slaughter, Warren, OH (US)

(73) Assignee: American Axle & Manufacturing, Inc., Detroit, MI (US)

( * ) Notice: Subject to any disclaimer, the term of this patent is extended or adjusted under 35 U.S.C. 154(b) by 0 days.

(21) Appl. No.: 10/694,631

(22) Filed: Oct. 27, 2003

(65) Prior Publication Data

US 2005/0086992 A1 Apr. 28, 2005

(51) Int. Cl.[7] ..... B21J 13/00

(52) U.S. Cl. ..... 72/355.4; 72/267; 72/359; 72/370.03; 29/897.2

(58) Field of Search ..... 72/267, 354.6, 72/355.4, 358, 359, 370.01, 370.03, 370.1, 72/370.11, 370.26; 29/897.2

(56) References Cited

U.S. PATENT DOCUMENTS 1,882,352 A * 10/1932 Woodhead et al. ..... 29/897.2
1,966,053 A * 7/1934 Squires ..... 72/342.1
3,714,320 A 1/1973 Shaw
3,977,227 A 8/1976 Noble
4,028,919 A 6/1977 Austen
4,224,816 A 9/1980 Elhaus et al.
4,249,408 A 2/1981 Lovell
4,322,256 A 3/1982 Henning
4,346,581 A * 8/1982 Ando ..... 72/347
4,557,131 A 12/1985 Wagner et al.
4,878,370 A 11/1989 Fuhrman et al.
4,945,749 A 8/1990 Walker et al.
5,203,194 A 4/1993 Marquardt
5,732,586 A 3/1998 Muessig et al.
5,765,425 A 6/1998 Pipan
5,956,988 A * 9/1999 Beste et al. ..... 72/57
6,212,929 B1 4/2001 Binhack
6,408,672 B1 6/2002 Roe et al.
6,796,574 B2 * 9/2004 Palmer ..... 280/495

* cited by examiner

*Primary Examiner*—Ed Tolan
(74) *Attorney, Agent, or Firm*—Harness, Dickey & Pierce P.L.C.

(57) ABSTRACT

A method of forging a trailer receiver tube by providing a die having an inner surface defining a first portion and a second portion. Providing a hollow tube having an outer surface. Providing a punch having a body and a shaft extending therefrom sized to fit within the hollow tube. Loading the hollow tube within the first portion of the die. Inserting the punch into the hollow tube such that the body abuts an end of the hollow tube and the shaft extends therethrough. Advancing the punch and the hollow tube through the die such that a portion of the hollow tube is extruded into the second portion of the die and the outer surface of the hollow tube conforms to the inner surface of the die to thereby form the trailer receiver tube.

14 Claims, 2 Drawing Sheets

METHOD OF FORMING A TRAILER RECEIVER TUBE USING HOLLOW FORWARD EXTRUSION

FIELD OF THE INVENTION

The present invention relates to a method of forming a trailer receiver tube and more particularly to a method of forming a trailer receiver tube using cold forward extrusion.

BACKGROUND OF THE INVENTION

Motor vehicles often employ a hitch assembly for towing a trailer. The typical hitch assembly is mounted to the rear of the motor vehicle and includes a hitch receiver tube and a removable hitch bar. The hitch receiver tube is permanently mounted to the motor vehicle using brackets and/or welds. The hitch receiver tube is sized to receive the hitch bar therein. The hitch bar has a ball or tongue onto which the trailer is mounted.

In most conventional hitch assemblies, the hitch receiver tube includes a reinforcing collar or ring mounted on the end of the hitch receiver tube into which the hitch bar is inserted. The protective collar or ring protects the inside shape of the tube from being deformed. Typically this protective collar or ring is welded onto the hitch receiver tube. While this method of construction has served well in the past, welding of the collar or ring onto the hitch receiver tube has some disadvantages. First, the hitch receiver tube is viewable from the rear of the motor vehicle, and the weld itself may not be aesthetically pleasing. Second, it increases the likelihood of water and debris being retained and resulting in the formation of rust. Finally, using a multiple piece assembly for the hitch receiver tube results in greater shipping, handling, and manufacturing costs than does employing a single piece assembly. An additional method of forming a one piece design by upsetting produces a visual defect in the tube.

Accordingly, it is an object of the present invention to provide the art with a new trailer receiver tube and a cold forward extrusion method of construction that eliminates the disadvantages found in prior art designs and methods.

SUMMARY OF THE INVENTION

A method of forging a trailer receiver tube is provided. The method includes providing a die having an inner surface defining a first portion and a second portion. A hollow tube is provided having an outer surface. A punch is provided having a body and a shaft extending therefrom sized to fit within the hollow tube. The hollow tube is loaded within the first portion of the die. The punch is inserted into the hollow tube such that the body abuts an end of the hollow tube and the shaft extends therethrough. The punch and the hollow tube is advanced through the die such that a portion of the hollow tube is extruded into the second portion of the die and the outer surface of the hollow tube conforms to the inner surface of the die to thereby form the trailer receiver tube.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
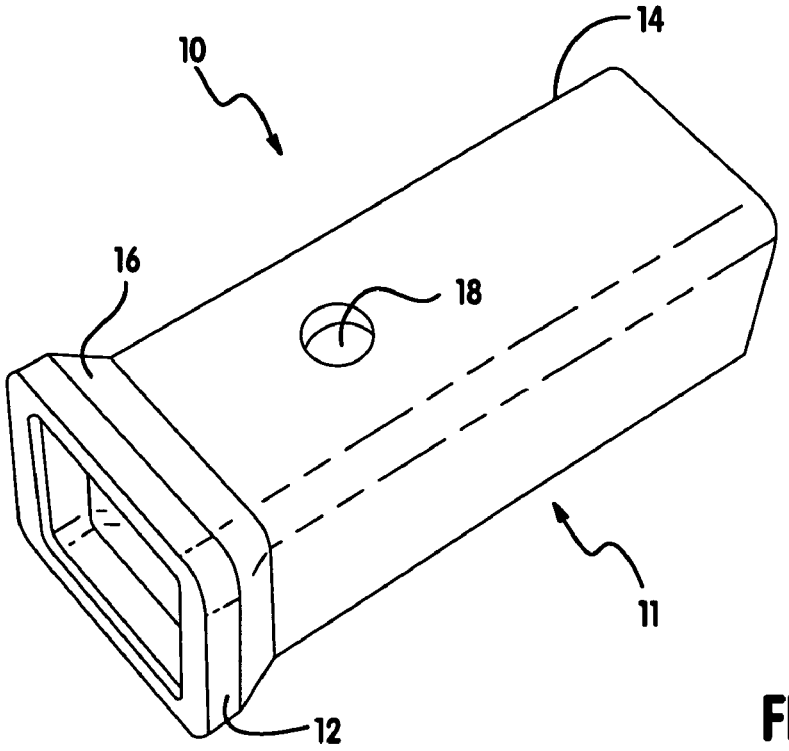
FIG. 1 is a perspective view of a trailer receiver tube constructed in accordance with the teachings of the present invention.

With reference to FIG. 1 of the drawings, a receiver tube that is constructed according to the method of the present invention is indicated generally by reference numeral 10. The receiver tube 10 is intended to be mounted beneath the floor pan or bumper of a motor vehicle (not shown). The receiver tube 10 is configured to receive a conventional hitch bar (not shown) of the type that is well known in the art.

The receiver tube 10 is unitarily formed as will be described in greater detail below and in the particular example provided, has a generally rectangular lateral cross section. However, various other cross-sectional shapes may be employed including, for example, a square or octagonal cross-sectional area. The receiver tube 10 generally includes an outer surface 11, a head portion 12 and a body portion 14. In the example provided, the head portion 12 transitions to the body portion 14 through a chamfered edge 16.

The head portion 12 is located at a distal end of the receiver tube 10 that receives the hitch bar (not shown) and provides a protective collar around the receiver tube 10. The body portion 14 extends from the head portion 12 and is adapted to be mounted to the motor vehicle (not shown). A hole 18 may be formed into the body portion 14 for receiving a locking pin (not shown) once the hitch bar (not shown) has been inserted into the receiver tube 10. In the embodiment illustrated, the body portion 14 has a wall thickness which is less than the wall thickness of the head portion 12.

Figure 2:
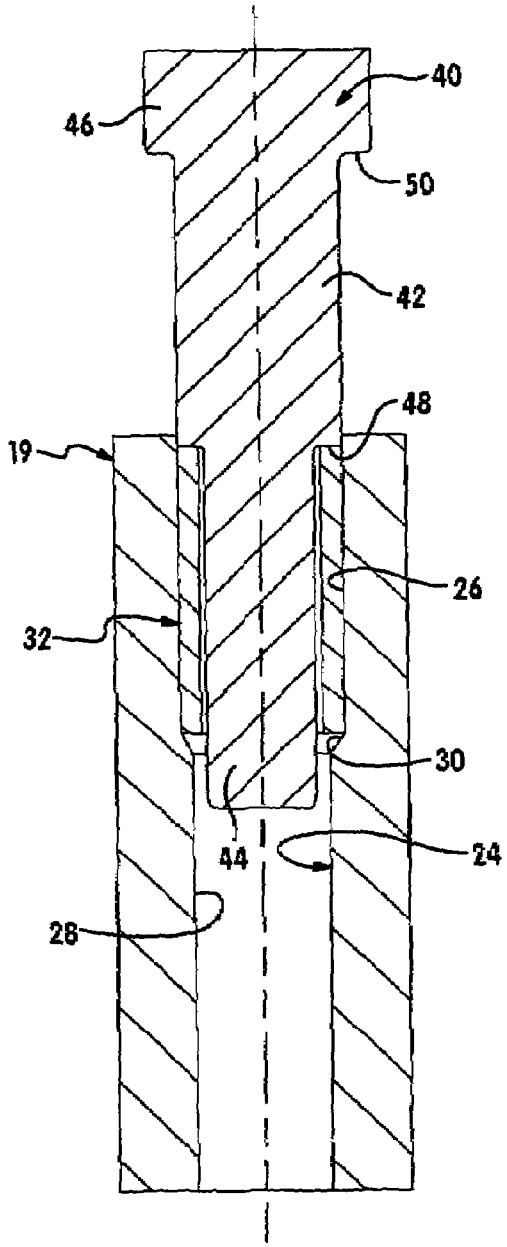
FIG. 2 is a longitudinal sectional view of a die, blank and punch in a loading stage used in the method of forming the trailer receiver tube of FIG. 1.

Turning to FIG. 2, a method of forming the receiver tube 10 will now be described in greater detail. The receiver tube 10 is formed using hollow forward (direct) extrusion. A die 19 is provided that defines an inner surface 24 having a first portion 26 and a second portion 28. In the example provided, the first portion 26 is characterized as defining an opening that is somewhat larger than that of the second portion 28. A chamfer forming portion 30 extends between the first portion 26 and the second portion 28 and is used to form the chamfered edge 16, as will be described below.

A tubular blank 32 is provided, which is made from a unitary piece of material, such as an ATSM A500 grade steel, or some other suitable material. The tubular blank 32 is illustrated to have a rectangular cross-sectional area, but those skilled in the art will appreciate that various other shaped cross sections may be employed. During the loading stage, as depicted in FIG. 2, the tubular blank 32 is placed in the die 19 within the first portion 26. The tubular blank 32 is sized relatively larger than the second portion 28 of the die 19 and, as such, remains within the first portion 26 during the loading stage.

A punch 40 is provided having a body 42, a shaft 44 that extends from an end of the body 42 and a base 46 that is formed on an opposite end of the body 42. In the example provided, a contact surface 48 is formed at the transition between the body 42 and the shaft 44. The body 42 is sized to fit within the first portion 26 of the die 19. The shaft 44 is sized to fit within the tubular blank 36.

During the loading stage as shown in FIG. 2, the punch 40 is inserted into the tubular blank 32 such that the shaft 44 extends into the tubular blank 32 and the contact surface 48 engages the loading end 36. In the example provided, the shaft 44 extends completely through the tubular blank 32 at this stage.

Figure 3:
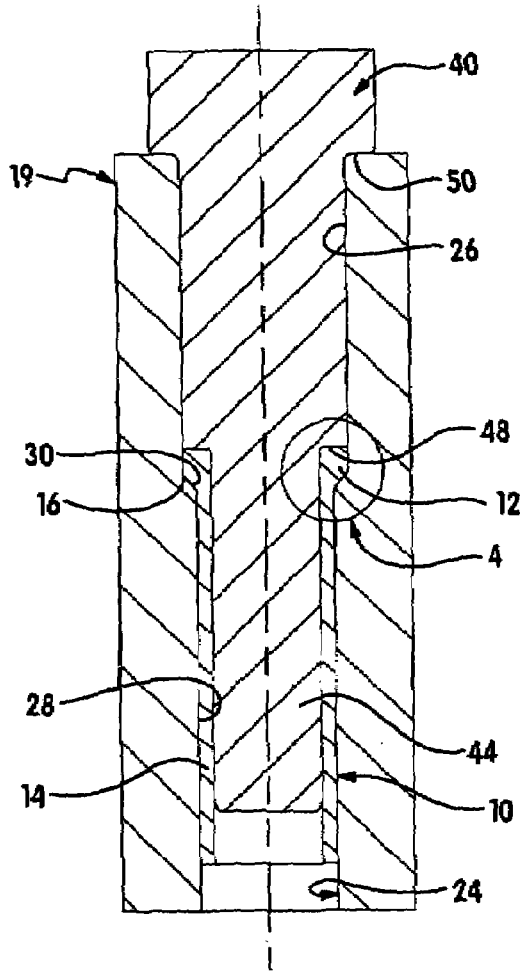
FIG. 3 is a longitudinal sectional view similar to that of FIG. 2, but illustrating the blank and punch in a final stage used in the method of forming the trailer receiver tube of FIG. 1.

With reference to FIG. 3, the receiver tube 10 is formed by hollow forward extruding the blank 32 through the die 19 using the punch 40. Preferably, the punch 40 is urged into the die 19 under ambient temperature conditions by a press ram (not shown). Alternatively, the punch 40 may be urged into the die 19 at elevated temperatures. The contact surface 48 engages the tubular blank 32 and forces the tubular blank 32 into the lower portion 28 of the die 19.

Fixed between the shaft 44 of the punch 40 and the die 19, the tubular blank 32 is subjected to compression forces as it is urged into the second portion 28. In the example provided, the tubular blank 32 increases in longitudinal length while simultaneously decreasing in wall thickness. The portion of the tubular blank 32 that is extruded into the second portion 28 forms the body portion 14 of the receiver tube 10.

The punch 40 is urged into the die 19 by the press ram (not shown) until such time as shim blocks (not shown) or a stroke limit on the press ram terminates the movement of the punch 40. A portion of the tubular blank 32 remains within the first portion 26 of the die 19 (i.e. is not extruded through the second portion 28) and thus forms the head portion 12. Accordingly, the head portion 12 retains the characteristics of the blank 32 and acts as a reinforcing area for the newly formed receiver tube 10. Chamfer forming portion 30 forms the chamfered edge 16 which acts as the transition between the head portion 12 and the body portion 14. The punch 40 is then retracted from the die 19 by a reverse stroke of the press ram (not shown). At that time, a knock-out stroke is initiated by the press ram to remove the receiver tube 10 from the die 19. Using the above extrusion method, the outer surface 11 of the receiver tube 10 is defined by the inner surface 24 of the die 19.

Figure 4:
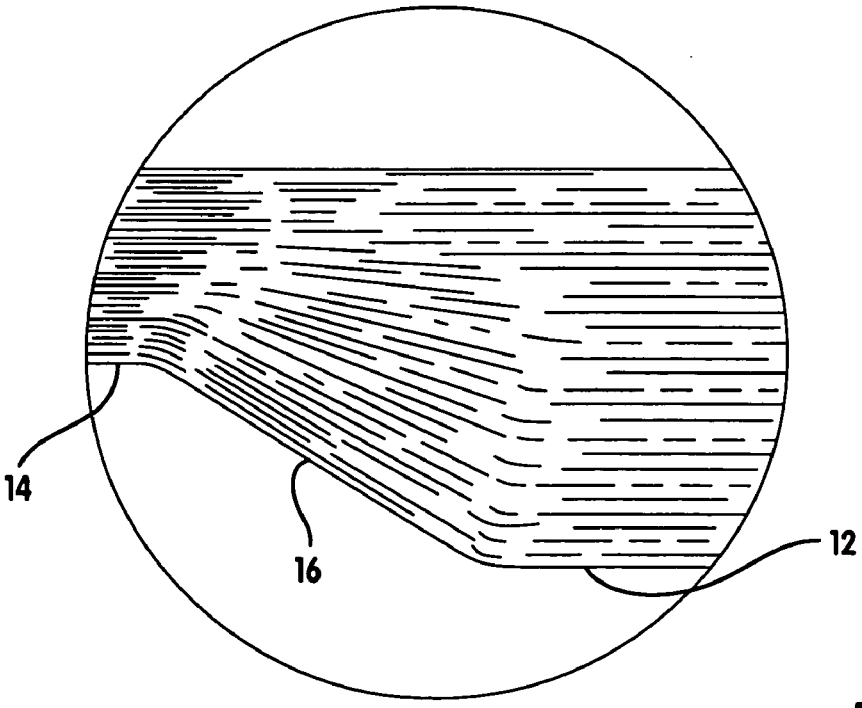
FIG. 4 is an enlarged cross-sectional view of the portion of the trailer receiver tube indicated by circle 4 in FIG. 3 illustrating the directional grain alignment in the trailer receiver tube.

Turning now to FIG. 4, the cross-sectional view of the head portion 12, the chamfered edge 16, and the body portion 14 of the receiver tube 10 illustrates the alignment of the grain within the receiver tube 10 after forming using the method described above. Specifically, the grain of the material within the head portion 12 and the body portion 14 extends parallel to the longitudinal axis of the receiver tube 10 (e.g. in the direction of the cold forward extrusion). The grain in the chamfered edge 16 runs at an angle to the longitudinal axis of the receiver tube 10 and parallel to the outer surface of the chamfered edge 18. The grains within the body portion 14 are compressed and closer together than the grains within the head portion 12.

The directional alignment of the grain within the head portion 12 and the body portion 14 provides improved strength properties. By preserving the grain flow of the tubular blank 32 within the head portion 12, characteristics such as grain ends or voids are eliminated. Using cold forward extrusion to form the body portion 14 preserves directional grain alignment.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method for forming a receiver tube that is adapted to receive a hitch bar, the method comprising:

providing a die, the die defining a die cavity with a first portion and a second portion, the first portion of the die having an upper surface and the second portion of the die having a lateral cross-section that is smaller than a lateral cross-section of the first portion;

providing a hollow tube having an inner surface and an outer surface;

providing a punch having a head, a body and a shaft, the head having a greater cross-section than both the body and the first portion of the die and including a lower surface thereon, the shaft extending from the body and being sized to fit within the hollow tube;

loading the hollow tube within the first portion of the die;

inserting the punch into the hollow tube such that the body abuts an end of the hollow tube; and advancing the punch toward the die such that the lower surface of the punch head contacts the upper surface of the die, resulting in only a portion of the hollow tube being extruded into the second portion of the die, the portion of the hollow tube in the second portion of the die forming a body portion of the receiver tube and an associated portion of the hollow tube remaining in the first portion of the die forming a head portion of the receiver tube, wherein the head portion of the receiver tube is sized to a predetermined axial length as a result of the contact between the lower surface of the punch head and the upper surface of the die.

2. The method of claim 1, wherein the hollow tube has a lateral cross-sectional shape selected from a group consisting of rectangular, square, and octagonal cross-sectional shapes.

3. The method of claim 1, wherein the first portion defines an opening that is larger than the hollow tube.

4. The method of claim 1, wherein the first portion includes a substantially constant portion and a transition portion, the transition portion being in juxtaposed relation with the substantially constant portion and the second portion of the die.

5. The method of claim 4, wherein the transition portion tapers between the substantially constant portion and the second portion of the die so that a chamfer is formed on the head portion adjacent the body portion.

6. The method of claim 1, wherein the portion of the hollow tube extruded into the second portion of the die has a wall thickness less than a wall thickness of the portion of the hollow tube in the first portion of the die.

7. The method of claim 1, wherein the shaft extends through the hollow tube after the step of inserting the punch into the hollow tube.

8. The method of claim 1, wherein the hollow tube has a substantially uniform wall thickness.

9. The method of claim 1, wherein the shaft is unitarily formed.

10. The method of claim 9, wherein the entire punch is unitarily formed.

11. The method of claim 1, wherein the grain of the material of the trailer receiver tube within the head portion and the body portion extends parallel to a longitudinal axis of the receiver tube.

12. The method of claim 5, wherein the grain of the material of the trailer receiver tube within the chamfer runs at an angle to a longitudinal axis of the trailer receiver tube and parallel to an outer surface of the chamfer.

13. The method of claim 1, wherein the hollow tube is completely contained on the shaft of the punch and extends past the shaft after the punch has been advanced to form the receiver tube.

14. The method of claim 1, wherein the inner surface and the outer surface of the hollow tube are simultaneously formed by the punch and the die.

* * * * *